United States Patent [19]

Yoshida

[11] Patent Number: 4,685,758

[45] Date of Patent: Aug. 11, 1987

[54] CONNECTOR PLUG

[75] Inventor: Noboru Yoshida, Gunma, Japan

[73] Assignee: Hosiden Electronics Co., Ltd., Osaka, Japan

[21] Appl. No.: 835,662

[22] Filed: Mar. 3, 1986

[30] Foreign Application Priority Data

Jun. 7, 1985 [JP] Japan ..... 60-86147[U]

[51] Int. Cl.[4] ..... H01R 13/658

[52] U.S. Cl. ..... 439/606; 439/607; 439/680

[58] Field of Search ..... 339/14 R, 143 R, 139 R, 339/102 R, 184 M, 186 M

[56] References Cited

U.S. PATENT DOCUMENTS

| | | | |
|---|---|---|---|
| 1,635,323 | 7/1927 | Ile | 339/139 R |
| 3,275,970 | 9/1966 | Johanson et al. | 339/143 R |
| 3,986,765 | 10/1976 | Shaffer et al. | 339/94 A |
| 4,131,332 | 12/1978 | Hogendobler et al. | 339/143 R |
| 4,493,525 | 1/1985 | Hall et al. | 339/143 R |
| 4,579,415 | 4/1986 | Van Brunt et al. | 339/143 R |
| 4,597,624 | 7/1986 | Lax et al. | 339/143 R |

*Primary Examiner*—John McQuade

*Attorney, Agent, or Firm*—Pollock, Vande Sande and Priddy

[57] ABSTRACT

A connector plug is disclosed, in which a plurality of contact pins are embedded in an insulating body mounted in a cylindrical metal cover. A shielded cable having wires connected to contact pins is led out from the cylindrical metal cover. A cylindrical shield conductor which is fitted on the shielded cable is fitted on and secured to a rear portion of the cylindrical metal cover. A rear end portion of the cylindrical shield conductor is caulkedly urged against the cable, thus clamping the cable. A shield braid of the cable is electrically connected to the cylindrical shield conductor. The outer periphery of a rear portion of the cylindrical metal cover and cylindrical shield conductor is covered by an insulating cap.

8 Claims, 11 Drawing Figures

CONNECTOR PLUG

BACKGROUND OF THE INVENTION

This invention relates to a connector plug used for interconnection of audio-equipments, video-equipments, personal computers and their peripheral equipments.

A connector plug is described in Japanese Utility Model Publication No. 59-79986, entitled "Connector Plug", which has two features. One of the features is that, although the plug is small in size, it can provide a strong force with which it is held fitted in a connector socket, and offers a strong resistance against a force tending to pull it out from the socket so that it is less liable to be accidentally detached from the socket. The other feature is that, although it is small in size, it permits ready positioning of pins when the plug is inserted into the connector socket.

The structure of this prior art connector plug will now be described with reference to FIGS. 1 to 6. FIG. 1 shows a perspective view of the connector plug. It comprises a cylindrical metal cover 101, which accommodates an insulating body 102 fitted in it. A plurality of contact pins 103 extend through insulating body 102 in the axial direction of cylindrical metal cover 101. This example of the connector plug has five contact pins 103. Metal cover 101 is covered by an insulating cap 104 except for its front portion. Insulating cap 104 has a rear cable protector portion 105, through which a cable 300 is led out from metal cover 101.

This prior art connector plug structure has two features. One of the features is that metal cover 101 is cylindrical. The other feature is that a front portion of metal cover 101 has a main positioning ridge 106 and a plurality of auxiliary positioning ridges 107*a* and 107*b*, these ridges protruding radially inwardly from the inner cylindrical surface of metal cover 101. Main positioning ridge 106 is distinguished from auxiliary positioning ridges 107*a* and 107*b* by its shape and size. Main positioning ridge 106 has a greater circumferential width dimension and a greater height than auxiliary positioning ridges 107*a* and 107*b*. Due to this difference in shape, main positioning ridge 106 is prevented from being engaged in a recess or groove on the socket side, in which auxiliary positioning ridge 107*a* or 107*b* is to be engaged. The plug thus can be inserted in a fixed orientation.

The front ends of main and auxiliary positioning ridges 106, 107*a* and 107*b* are offset a fixed distance L from the front end of cylindrical metal cover 101. Cylindrical metal cover 101 has a cut-away part 108 open at its front end. Cut-away part 108 is provided for avoiding engagement of the plug with a portion of the socket and permits size reduction of the socket.

Insulating body 102 has an insulating bar-like member 109 integrally extending forwardly from the front end thereof together with contact pins 103. Insulating bar-like member 109 is provided at different positions according to the number of contact pins 103 provided in insulating body 102. FIGS. 2 to 4 show connector plugs having different numbers of pins 103. Insulating bar-like member 109 is provided at different positions in the front end of these connector plugs. The connector plug shown in FIG. 2 has three pins. The connector plug shown in FIG. 3 has four pins. The connector plug shown in FIG. 4 has eight pins. In these examples, eight pins are the maximum number of pins that are carried together. When the connector plug has the said maximum number of pins, insulating bar-like member 109 is omitted. That is, insulating bar-like member 109 is provided on only the connector plugs having three to seven pins.

The socket is provided with a hole, in which insulating bar-like member 109 is to be received. The positional relation between insulating bar-like member 109 and the socket hole prevents erroneous insertion of a plug into a socket for a plug having a different number of pins. Insulating bar-like member 109 has a slightly greater length than contact pins 103, by which it extends from insulating body 102, than contact pins 103. Thus, it is only when insulating bar-like member 109 is first inserted into the corresponding hole in the socket that contact pins 103 can then be inserted into corresponding contact pin holes in the socket.

FIG. 5 shows the internal structure of the prior art connector plug. Contact pins 103 are preliminarily planted, for instance by forced piercing, in insulating body 102 such that their contact portions project from the front end of insulating body 102 and their connecting terminal portions project from the rear end of insulating body 102. Insulating body 102 with contact pins 103 is inserted into cylindrical metal cover 101 from the rear end thereof. Wires of cable 300 are preliminarily soldered to the connecting terminal portions of corresponding contact pins 103 projecting from the rear end of insulating body 102.

Cylindrical metal cover 101 is formed by pressing a resilient metal sheet into a cylindrical form. The opposite edges of the metal sheet are made free edges to permit resilient deformation of cover 101 in the diametrical direction. Cylindrical metal cover 101 has a plurality of protuberances 301 projecting from the inner peripheral surface thereof. These protuberances 301 are adapted to be received in recesses 302 formed in the outer periphery of insulating body 102 when insulating body 102 is inserted into cylindrical metal cover 101.

When insulating body 102 is inserted until protuberances 301 are engaged in recesses 302 of insulating body 102, inwardly bent portions 303 of cylindrical metal cover 101 formed rearwardly of protuberances 301 are engaged in recesses 302 formed in insulating body 102 at the circumferential edge adjacent to the rear end. Insulating body 102 thus is locked in cylindrical metal cover 101 by protuberances 301 and bent portions 303.

Cylindrical metal cover 101 has a cable clamp 305 extending from its rear end. Cable clamp 305 consists of an arcuate clamp portion 306 and a connecting portion 307 connecting clamp portion 306 and the rear end of cylindrical metal cover 101. Clamp portion 306 has a plurality of inner teeth 308.

After insulating body 102 has been installed in cylindrical metal cover 101, clamp portion 306 of cable clamp 305 is bent inwardly to wedge it into the insulating cover of cable 300. Cable 300 is secured to cylindrical metal cover 101 by the wedging of teeth 308 of clamp portion 306 into the insulating sheath of cable 300.

After cable 300 has been secured by cable clamp 305 to cylindrical metal cover 101, cylindrical metal cover 101 with the insulating body 102 therein are set into a mold for resin molding to form insulating cap 104 with cable protector portion 105, as shown in FIG. 6. When molding insulating cap 104 with cable protector portion 105 with a resin, the resin intrudes into the interior of cylindrical metal cover 101 through openings 309 or windows that are formed when forming inwardly bent portions 303, whereby cylindrical metal cover 101 and cable 300 are molded in insulating cap 104 with cable protector portion 105.

This prior art connector plug has the following advantages.

(a) Since metal cover 101 is formed by bending a metal sheet into a cylindrical form (unlike a connector plug which was provided earlier to this prior art connector plug where a cylindrical metal cover was assembled from two semi-cylindrical halves), the resiliency of the cylindrical metal cover in the diametrical direction can be increased. It is thus possible to provide a connector plug which can provide a strong force, with which it is held fitted in the connector socket, and offer a strong resistance against a force tending to pull it out from the socket.

(b) Since the connector plug has main positioning ridge 106 and two or more auxiliary positioning ridges 107*a* and 107*b*, when the end portion of cylindrical metal cover 101 is inserted into a annular groove of the connector socket, these ridges 106, 107*a* and 107*b* are engaged with the cylindrical wall defining the annular groove, whereby the plug is supported. Therefore, for finding the inserting position of the plug, the plug can be turned without being inclined, i.e., with its axis coincident with the axis of the connector socket. Thus, the operation of finding the proper plug insertion position can be facilitated.

(c) With the provision of insulating bar-like member 109, the plug is not allowed to be inserted into the socket unless the contact pins of the plug correspond in number to the pin insertion holes of the socket. Therefore, there is no possibility of erroneous insertion of a plug into a socket which is provided for a plug having a different number of pins. Erroneous electric connection thus can be prevented. Further, with the engagement of insulating bar-like member 109 in the corresponding hole in the socket, the plug can be supported in the socket without rattling.

With the plug having eight contact pins, the eighth contact pin 103*h* (as shown in FIG. 4) is provided at a position different from the position of insulating bar-like member 109 of a connector plug having a different number of pins. Therefore, without insulating bar-like member 109 the plug will never be erroneously inserted into a connector socket for a plug having a different number of pins, particularly the plug having sever pins.

(d) Since insulating bar-like member 109 has a slightly greater length, by which it extends from the insulating body, than contact pins 103, contact pins 103 will never be inserted into contact pin holes of the socket unless insulating bar-like member 109 first inserted into the corresponding hole in the socket. Thus, a two-fold positioning can be obtained, i.e., one positioning function provided by positioning ridges 106, 107*a* and 107*b* and the other positioning function provided by insulating bar-like member 109. This has an effect of preventing the erroneous contact of a contact pin of a plug with a contact of an irrelevant circuit on the socket side when finding the regular inserting position of the plug.

(e) In the internal structure, arcuate clamp portion 306, which constitutes cable clamp 305 and has inner teeth 308, is bent to close the corresponding end of cylindrical metal cover 101, thereby causing teeth 308 to wedge into the insulating sheath of cable 300. The length of the plug thus can be reduced compared to prior art plugs having different cable clamp structures.

This prior art connector plug, however, has the following drawback. As shown in FIGS. 5 and 6, cylindrical metal cover 101 has hole 309 and windows or openings formed with bent portions 303 in order that the resin will enter its interior through these hole and openings when molding insulating cap 104 with cable protector portion 105. With this structure, a perfect electromagnetic shield effect can not be obtained. Particularly, when this connector plug is used for a connector for electrically interconnecting digital devices such as personal computers, noise is liable to be introduced through the connector due to the imperfect shield, or a signal is liable to leak as noise from the connector to the outside.

Further, since cable clamp 305 is integral with cylindrical metal cover 101, its thickness is small, so that the clamping force, with which to clamp cable 300 is liable to be insufficient. In other words, cylindrical metal cover 101 is made from a comparatively thin metal sheet in order that it is small in size and elastic. Therefore, where cable clamp 305 is integral with cylindrical metal cover 101, its mechanical strength is low, so that it can provide only a comparatively small clamping force.

SUMMARY OF THE INVENTION

An object of the invention is to provide a connector plug which can be smoothly coupled to a connector socket, provide a strong clamping force thereto and provide sufficient electromagnetic shielding.

Another object of the invention is to provide a connector plug which can be smoothly coupled to a connector socket, provide a strong clamping force thereto, provide sufficient electromagnetic shielding and strongly clamp a cable.

With the connector plug according to the invention, a cylindrical metal cover is free from any hole or opening formed in the peripheral wall, while the plug connector comprises an insulating body, contact pins, a shielded cable and an insulating cap as well as the cylindrical metal cover as in the prior art connector plug. Further, a cylindrical shield conductor is secured to a rear portion of the cylindrical metal cover to cover that portion. The cylindrical shield conductor has a reduced diameter rear portion which clamps a cable led from the cylindrical metal cover. The cylindrical metal cover and cylindrical shield conductor including the clamping portion are covered by the insulating cap.

Since the cylindrcal metal cover is free from any peripheral wall hole or opening and is covered by the cylindrical shield conductor, the inner contact pins can be reliably electromagnetically shielded from the outside. Further, by so forming the cylindrical shield conductor that it has a comparatively large thickness, it can have a high mechanical strength and clamp the cable strongly.

Further, it is possible to form peripheral wall holes and/or openings in the cylindrical metal cover. In this case, the portion formed with the holes and/or openings may be covered by the cylindrical shield conductor.

DETAILED DESCRIPTION OF THE PREFERRED EMBODIMENTS

Figure 1:
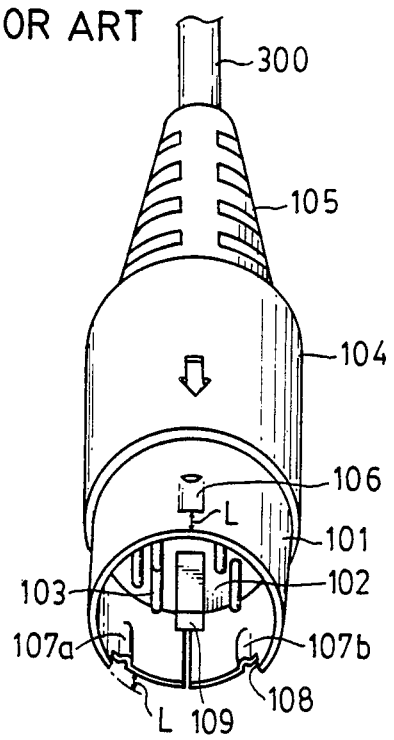
FIG. 1 PRIOR ART
FIG. 1 is a perspective view showing a prior art connector plug.
Figure 2:
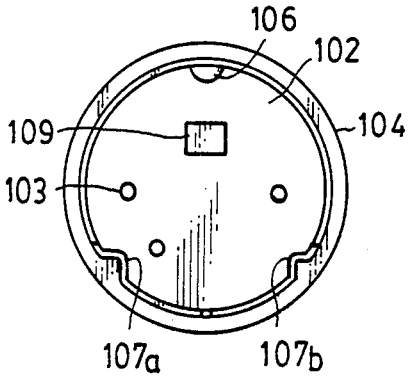
FIG. 2 PRIOR ART
FIG. 2 is a front view, to an enlarged scale, showing a prior art connector plug having three contact pins.
Figure 3:
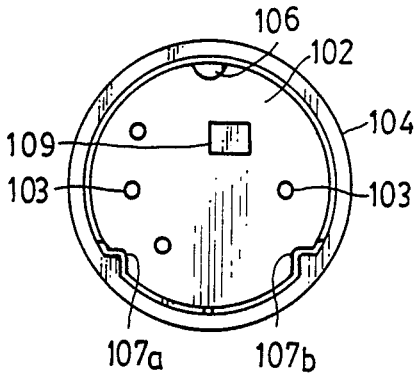
FIG. 3 PRIOR ART
FIG. 3 is a view similar to FIG. 2 but showing a prior art connector pin having four contact pins.
Figure 4:
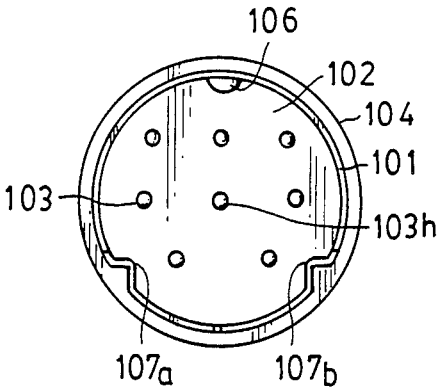
FIG. 4 PRIOR ART
FIG. 4 is a view similar to FIG. 4 but showing a prior art connector plug having eight pins.
Figure 5:
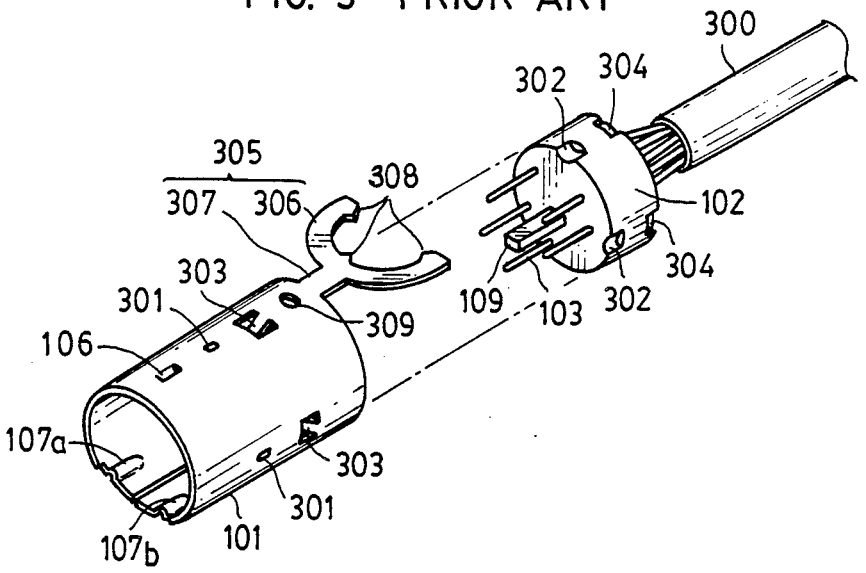
FIG. 5 PRIOR ART
FIG. 5 is a disassembled perspective view showing the internal structure of the prior art connector plug.
Figure 6:
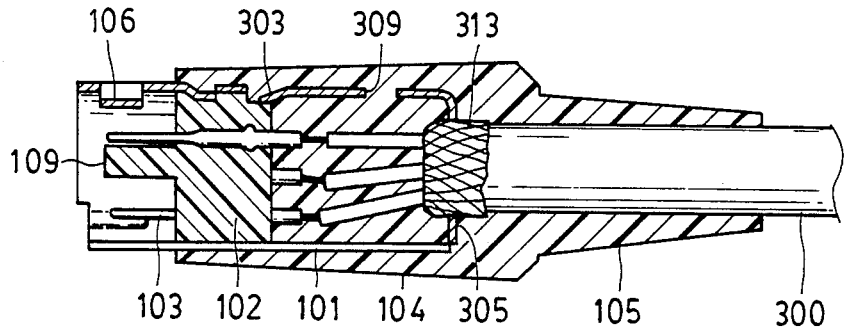
FIG. 6 PRIOR ART
FIG. 6 is an axial sectional view showing the prior art connector shown in FIG. 1.
Figure 7:
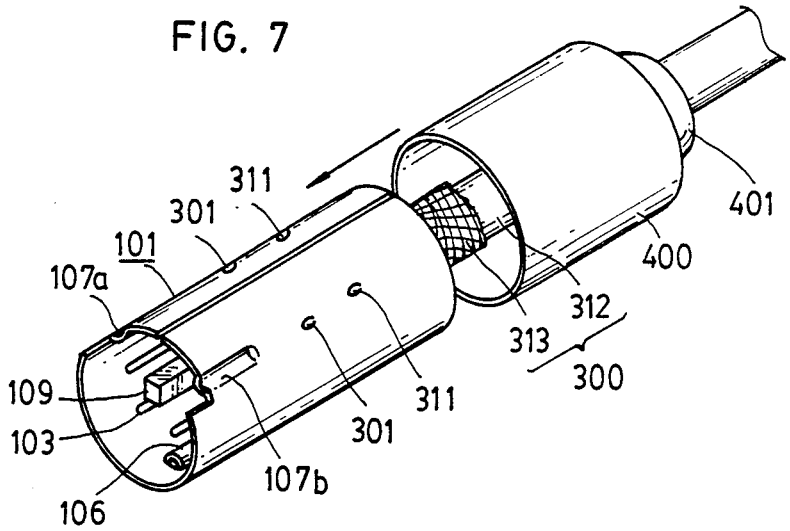
FIG. 7 is a perspective view showing a connector plug according to the invention, with a cylindrical metal cover about to be covered by a cylindrical shield conductor.

FIGS. 7 to 10 show an embodiment of the connector plug according to the invention. FIG. 7 shows the embodiment with cylindrical shield conductor 400 about to be fitted on a rear portion of cylindrical metal cover 101. In cylindrical metal cover 101 shown in FIG. 7, insulating body 102 described earlier in connection with FIG. 5, has already been installed. In this example, insulating body 102 is secured in position by smooth protuberances formed by pressing the outer peripheral wall of cylindrical metal cover 101 inwardly without cutting therein any hole or slot. More specifically, after connecting wires of cable 300 to contact pins 103, insulating body 102 is inserted into cylindrical metal cover 101 from the rear end thereof. At this time, recesses 302 formed in insulating body 102 (FIGS. 5 and 10) are engaged with protuberances 301. Also, protuberances 311 are formed on cylindrical metal cover 101 using a tool such that they project into notches 304 formed in insulating body 102 adjacent to the rear end thereof. Insulating body 102 thus is secured in position in cylindrical metal cover 101.

In the portion of cable 300 which is led out from the rear end of cylindrical metal cover 101, shield braid 313 is folded back onto insulating sheath 312 of cable 300 in the same way as in the case of clamping a cable with a conventional cable clamp.

Cylindrical shield conductor 400 is formed by a drawing operation, for instance, such that its inner diameter is slightly greater than the outer diameter of cylindrical metal cover 101. Cylindrical shield conductor 400 has been fitted on cable 300, and it is fitted on cylindrical metal cover 101 from the rear end thereof. Cylindrical shield conductor 400 has a rear end portion 401 of reduced diameter, and cylindrical shield conductor 400 is fitted onto cylindrical metal cover 101 until reduced diameter portion 401 comes immediately behind the rear end of cylindrical metal cover 101.

Figure 8:
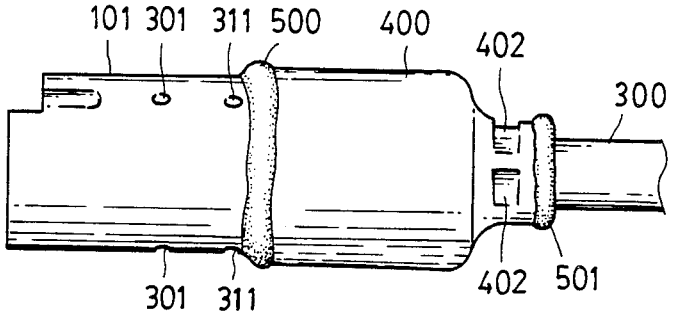
FIG. 8 is a side view showing the connector plug according to the invention with an insulating cap removed.
Figure 10:
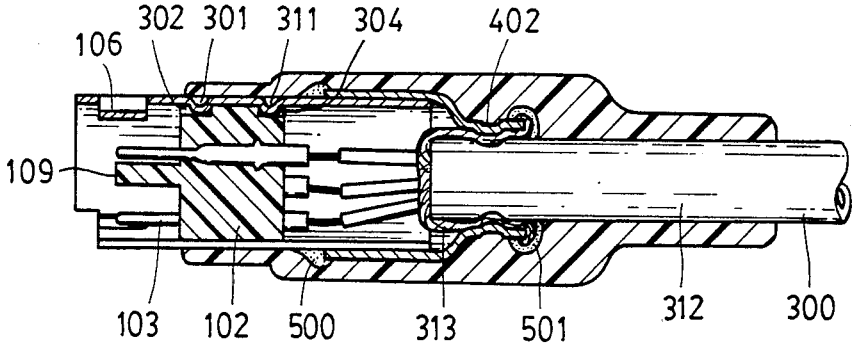
FIG. 10 is a side view of the connector plug shown in FIG. 9.

The length, by which shield braid 313 is folded back, is so selected that the folded back end portion of shield braid projects outwardly from the rear end of reduced diameter portion 401 of cylindrical shield conductor 400 when cylindrical shield conductor 400 is fitted onto cylindrical metal cover 101 up to the position at which reduced portion 401 is immediately adjacent the rear end of cylindrical metal cover 101. In this state, i.e., with shield braid 313 projecting from the rear end of reduced diameter portion 401, reduced diameter portion 401 is press-choked to clamp cable 300. In this way, cylindrical shield conductor 400 is secured to cable 300. By the press-choking, recesses 402 are formed in reduced diameter portion 401, as shown in FIGS. 8 and 10. At this time, the front end of cylindrical shield conductor 400 is secured in place by applying solder 500 to the outer periphery of cylindrical metal cover 101. The portion of shield braid 313 projecting from the rear end of reduced portion 401 is folded to be fitted onto the outer periphery of reduced diameter portion 401 of cylindrical shield conductor 400 and is connected by solder 501 thereto, thereby achieving an electrically stable connection of shield braid 313, cylindrical metal cover 101 and cylindrical shield conductor 400.

Figure 9:
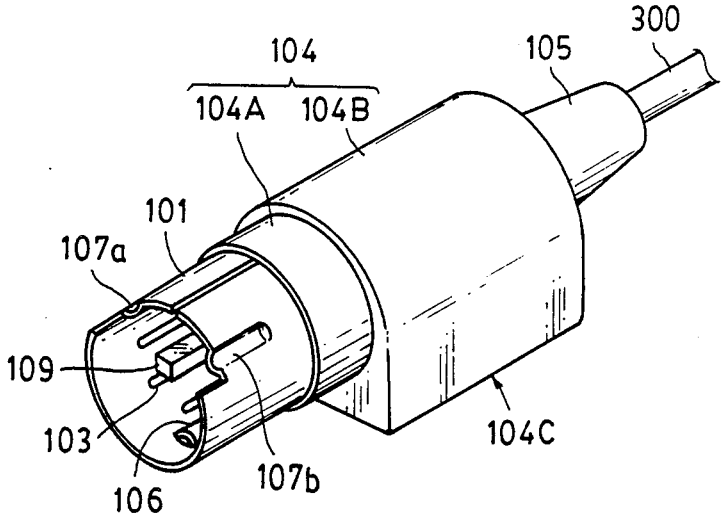
FIG. 9 is a perspective view showing a connector plug embodying the invention.

After the assembly as shown in FIG. 8 has been obtained, cylindrical metal cover 101 and cylindrical shield conductor 400 are set in a mold, and insulating cap 104 with cable protector portion 105 is molded to cover a rear portion of cylindrical metal cover 101, cylindrical shield conductor 400 and a portion of cable 300 lead out therefrom, as shown in FIGS. 9 and 10. Insulating cap 104 in this example, has a small thickness portion 104A having a small outer diameter and a large thickness portion 104B having a greater outer diameter. Small thickness portion 104A is provided to intervene between the front end of insulating cap 104 and an exposed portion of cylindrical metal cover 101. With this structure of insulating cap 104, having two portions of different outer diameters, large thickness portion 104B is usually taken hold of when inserting the connector plug into the connector socket or removing the plug. Since the outer periphery of large thickness portion 104B is sufficiently spaced apart from the exposed portion of cylindrical metal cover 101, it is difficult for a finger holding the connector plug to touch the exposed portion of cylindrical metal cover 101. If cylindrical metal cover 101 is touched by a person's body which is electrically charged, a discharge into an electronic device, which is connected to a cylindrical metal cover 101 through cable, will occur. In such a case, rupture of semiconductor elements, etc. in the device is liable to be caused by the discharge current. The probability of occurrence of such an accident can be reduced with the structure of this example of insulating cap 104, having two, i.e., large and small, outer diameter portions since the fingers of a person holding the connector plug are less liable to touch cylindrical metal cover 101.

Further, large thickness portion 104B of insulating cap 104 in this example has a flat surface 104C as part of its outer periphery. Thus, the rotational angular position of cylindrical metal cover 101 can be sensed by touching flat surface 104C. This facilitates the positioning of the connector plug with respect to the socket when inserting the plug.

As has been shown, according to the invention cylindrical shield conductor 400 is fitted onto a rear portion of cylindrical metal cover 101, and the rear end of shield braid 313 of cable 300 is soldered to the rear end of cylindrical shield conductor 400. The rear end of cylindrical metal cover 101 thus is substantially perfectly shielded.

Thus, it is possible to provide a connector plug wherein noise is neither introduced to nor leaks out at a connector.

Further, the front end of cylindrical shield conductor 400 is secured by solder 500 to the outer periphery of cylindrical metal cover 101, and reduced diameter portion 401 provided at the rear end of cylindrical shield conductor 400 is caulked against cable 300. The cable 300 thus is clamped by cylindrical shield conductor 400. Cylindrical shield conductor 400, unlike cylindrical metal cover 101, need not have resiliency, so that it may have a large thickness. Thus, it can provide a strong clamping force to cable 300.

In addition, cylindrical shield conductor 400 can have high mechanical strength for it may have a large thickness. Therefore, although cylindrical metal cover 101 is hollow, it will never be crushed by any resin injection pressure when molding insulating cap 104.

Incidentally, cylindrical metal cover 101 usually is given suitable elasticity so that the connector plug can be coupled to the connector socket comparatively smoothly and be held coupled by a strong holding force.

In the above embodiment, insulating body 102 is secured in position in cylindrical metal cover 101 by clamping it with protuberances 311. However, it is possible to use inwardly bent portions 303 described before in connection with FIG. 5 to this end. In this case, the interior of cylindrical metal cover 101 may be electromagnetically shielded by covering the outer periphery thereof with cylindrical shield conductor 400 up to a position beyond inwardly bent portions 303.

Figure 11:
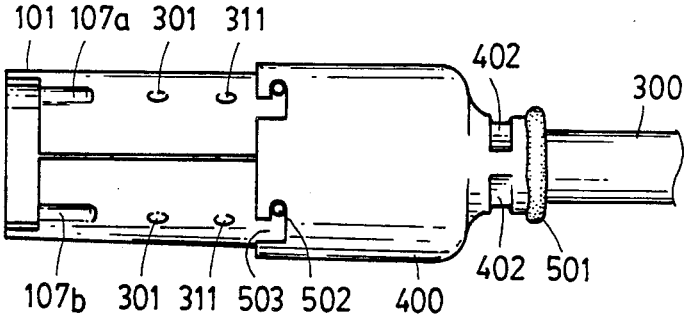
FIG. 11 is a view showing a modification of the securement of cylindrical metal cover and cylindrical shield conductor in a connector plug according to the invention.

Further, in the above embodiment the front end of cylindrical shield conductor 400 is soldered to cylindrical metal cover 101. FIG. 11 shows a modification of the way in which cylindrical metal cover 101 and cylindrical shield conductor 400 can be coupled together. In this modification, the outer periphery of cylindrical metal cover 101 is provided with projections 502. Projections 502 are formed before pressing a metal sheet into cylindrical form. Cylindrical shield conductor 400, on the other hand, is formed with L-shaped notches 503 adjacent to its front end. The front end of cylindrical shield conductor 400 is secured to cylindrical metal cover 101 by the engagement between projections 502 and L-shaped notches 503.

Further, while the above description concerns a structure where cable 300 extends in the direction in which the connector plug is to be inserted and removed, the invention is also applicable to the case where the connector plug is inserted and removed in directions perpendicular to the direction in which cable 300 extends.

What is claimed is:

1. A connector plug comprising:

an insulating body;

a plurality of contact pins carried by said insulating body in parallel relation to each other, each of said pins having a contact portion and a terminal portion extending outwards of the front and rear ends of said insulating body respectively;

a cylindrical metal cover comprising a resilient metal sheet rolled into a cylindrical form of substantially constant diameter, the opposite edges of the sheet being free edges to permit resilient deformation of said cylindrical metal cover in its diametrical direction, said cylindrical metal cover having a front end and a rear end, said insulating body being disposed within said cylindrical metal cover with the rear end of said insulating body located inward of the rear end of said cover so that said rear end of said insulating body and an inner wall surface of said cylindrical metal cover rearward of said rear end of said insulating body jointly define an open space;

a plurality of smooth protuberances extending inwardly of the outer periphery of said cylindrical metal cover, said insulating body being fixedly engaged by said protuberances with said contact pins extending parallel to the axis of said cylindrical metal cover toward the front end of said cover;

a shielded cable located adjacent the rear end of said open space and having a plurality of conductor wires which extend into said open space and are connected in said open space to said terminal portions of said contact pins, said cable including an interior shield braid an end portion of which is folded back onto an exterior surface of said cable to cover the end portion of said shielded cable from which said conductor wires extend, said shielded cable extending rearwardly of said open space and outwards of said cylindrical metal cover from the rear end of said cover;

a conductive cylindrical shield having a large diameter portion which is fitted around the rear end of said cylindrical metal cover to substantially cover said open space, said conductive cylindrical shield having a wall thickness greater than that of said cylindrical metal cover and having a rear end portion of reduced diameter which is positioned on the folded-back portion of said shield braid and caulkedly urged against said shielded cable, thereby closing said open space at the rear end thereof, said conductive cylindrical shield also having a front end portion which is soldered to the outer periphery of said cylindrical metal cover; and an insulating cap molded directly onto and around the outer periphery of said cylindrical metal cover except for a front end portion of said cover whereby said front end portion of said cover remains exposed, said cap including a comparatively thin wall portion extending rearwardly of said exposed portion of said metal cover and a thicker wall portion of greater diameter than said thin wall portion integral with said thin wall portion and extending rearwardly thereof around the outer periphery of said conductive cylindrical shield and beyond said rear end portion of said conductive cylindrical shield, a rear portion of said insulating cap extending along and around said shielded cable to define a cable protector.

2. The connector plug according to claim 1, where a portion of said conductive cylindrical shield connected between said reduced diameter portion and said large diameter portion is in contact with the rear end of said cylindrical metal cover.

3. The connector plug according to claim 1 wherein said insulating body has first notches formed in its outer periphery adjacent to the front end of said body and second notches formed in its outer periphery rearwardly of said first notches, said insulating body being fixed in said cylindrical metal cover by the engageemnt of said first and second smooth protuberances in said first and second notches.

4. The connector plug according to claim 1, wherein said folded-back shield braid is soldered to said reduced diameter portion of said cylindrical shield.

5. The connector plug according to claim 1, wherein said insulating body carries a bar-like angular positioning member extending from the front end thereof to an extent greater than said contact pins.

6. The connector plug according to claim 1, wherein said cylindrical metal cover has a plurality of axial angular positioning ridges on the inner periphery thereof in front of said insulating body.

7. The connector plug according to claim 6, wherein said axial angular positioning ridges of said cylindrical metal cover are slightly, offset rearwardly from the front end of said cover.

8. The connector plug according to claim 1, wherein said insulating cap has a flat surface constituting a portion of the outer periphery thereof.

* * * * *